US008364054B2

(12) United States Patent
Mihai et al.

(10) Patent No.: US 8,364,054 B2
(45) Date of Patent: Jan. 29, 2013

(54) REDUCTION OF CONTAMINATION ON IMAGE MEMBERS BY UV OZONE TREATMENT

(75) Inventors: Nicoleta D. Mihai, Oakville (CA); Samantha M. Roland, Oakville (CA); Kurt Halfyard, Mississauga (CA); T. Brian McAneney, Burlington (CA)

(73) Assignee: Xerox Corporation, Norwalk, CT (US)

( * ) Notice: Subject to any disclaimer, the term of this patent is extended or adjusted under 35 U.S.C. 154(b) by 530 days.

(21) Appl. No.: 12/436,383

(22) Filed: May 6, 2009

(65) Prior Publication Data

US 2010/0284714 A1 Nov. 11, 2010

(51) Int. Cl.
*G03G 21/00* (2006.01)

(52) U.S. Cl. ..... 399/98; 399/327; 430/119.86

(58) Field of Classification Search ..... 399/91, 399/98, 122, 320, 327, 328–331; 219/216, 219/244; 250/504 R; 430/119.7, 119.86; 134/1

See application file for complete search history.

(56) References Cited

U.S. PATENT DOCUMENTS

| | | | | |
|---|---|---|---|---|
| 5,592,879 | A * | 1/1997 | Waizmann | 101/416.1 |
| 2002/0129833 | A1 * | 9/2002 | Drzal et al. | 134/1 |
| 2008/0187852 | A1 * | 8/2008 | Kitano et al. | 430/104 |

OTHER PUBLICATIONS

Sowell, R. R., R. E. Cuhrell, D. M. Mattox and R. D. Bland, "Surface cleaning by ultraviolet radiation," J. Vac. Sci. Technol., vol. 11, No. 1, Jan./Feb. 1974, pp. 474-475.

Vig, John R. Handbook for Semiconductor Wafer Cleaning Technology. Science, Technology and Applications. Ultraviolet-Ozone Cleaning of Semiconductor Surfaces. Ed. Werner Kern Associates. New Jersey: Noyes Publications, 1993, pp. 233-273.

* cited by examiner

*Primary Examiner* — Walter L Lindsay, Jr.
*Assistant Examiner* — Benjamin Schmitt
(74) *Attorney, Agent, or Firm* — MH2 Technology Law Group LLP

(57) ABSTRACT

Exemplary embodiments provide a method and a system that can include a combined UV radiation and ozone treatment for reducing contamination built-up on surfaces of image members within a printing system.

19 Claims, 5 Drawing Sheets

REDUCTION OF CONTAMINATION ON IMAGE MEMBERS BY UV OZONE TREATMENT

DETAILED DESCRIPTION

1. Field of Use

The present teachings relate generally to materials and methods in electrophotography and, more particularly, to surface treatment systems and methods for reducing contamination built-up on image members in an electrophotographic printing machine.

2. Background

In conventional xerography, electrostatic latent images are formed on a xerographic surface by uniformly charging a charge retentive surface, such as a photoreceptor. The charged area is then selectively dissipated in a pattern of activating radiation corresponding to the original image. The latent charge pattern remaining on the surface corresponds to the area not exposed by radiation and is visualized by passing the photoreceptor by one or more developer housings. The developer housings typically include thermoplastic toner that adheres to the charge pattern by electrostatic attraction. The developed image is then fixed to the imaging surface or transferred to a receiving substrate, such as a paper sheet, to which it is fixed by a suitable fusing technique resulting in a xerographic print or toner-based print.

Conventional xerographic machines include a fuser roll and a pressure roll in a fusing unit whose role is to fuse the toner to the paper substrate under heat and pressure. During the fusing process, release agents are applied to the fuser roll to ensure and maintain good release properties of the fuser roll. The release agents include non-functional silicone oils, or mercapto-/amino-functional silicone oils, such as for example polydimethylsiloxane (PDMS) oils, that are applied as thin films of low surface energy to prevent toner offset on the fuser roll.

Over cycles of operation, contamination is built-up on the surface of the fuser roll, which may cause various forms of toner offset including, for example, gelled oil, pigment staining, toner resin and zinc fumarate (i.e., a by-product of toner additives). Such contamination on the fuser roll surface often results in image quality defects and causes early failure of the fuser roll.

Thus, there is a need to overcome this problem and other problems of the prior art and to provide a method and a system for reducing contamination built-up on surfaces of image members.

SUMMARY

According to the embodiments illustrated herein, there is provided a method for reducing contamination that builds-up on surfaces of image members. The image members can include, but are not limited to, a fuser member such as a fuser roll, a pressure member, a heat member, a donor member or other imaging or fixing members used in xerographic printers and copiers.

Additional objects and advantages of the present teachings will be set forth in part in the description which follows, and in part it will be obvious from the description, or may be learned by practice of the present teachings. The objects and advantages of the present teachings will be realized and attained by means of the elements and combinations particularly pointed out in the appended claims.

It is to be understood that both the foregoing general description and the following detailed description are exemplary and explanatory only and are not restrictive of the present teachings, as claimed.

According to one embodiment, there is provided a method for treating a surface of an image member. The surface of the image member can be contaminated from a printing process by, for example, a release agent and/or a toner material. To reduce the surface contamination of the imaging member, ultraviolet radiation can be used to irradiate the surface at one or more UV wavelengths, applying a combined UV radiation and ozone treatment.

According to another embodiment, there is provided a method for treating a surface of an image member. In this method, at least one ultraviolet (UV) light source can be used to irradiate a contaminated surface of the image member at one or more wavelengths to apply UV radiation and ozone treatment. During the surface treatment by irradiation, the at least one UV light source can be positioned a distance d away from the contaminated surface.

According to an additional embodiment, there is provided a method for reducing a contamination of an image member surface. In this method, the contaminated surface of the image member can be irradiated at a first UV wavelength and at a second UV wavelength using a UV light source that is placed at a distance d away from the contaminated surface. The irradiation with one of the first and second UV wavelengths can generate ozone to help with decontaminating the contaminated surface of the image member.

According to a further embodiment, there is provided an electrophotographic system for decontaminating a contaminated surface. Such system can include an image member and at least one light source positioned at a distance d from the image member. The distance d can be selected to permit the light source to irradiate and decontaminate a surface of the image member, which is contaminated by a release agent and/or a toner material. The light source can be capable of irradiating at one or more UV wavelengths so as to apply a combined UV and ozone treatment to the contaminated surface of the image member.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1:
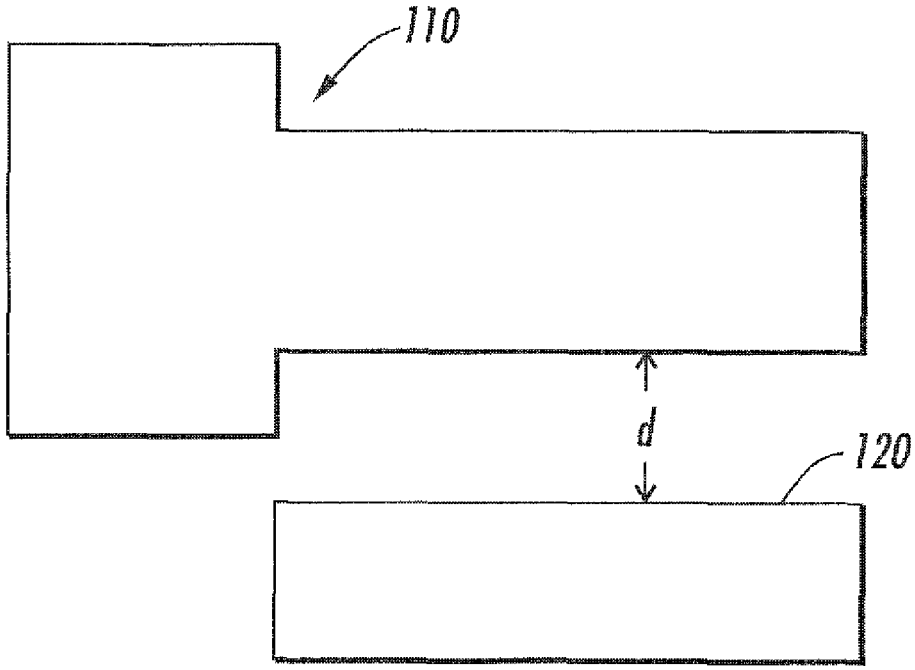
FIG. 1 is a block diagram for an exemplary decontamination system in accordance with various embodiments of the present teachings.

It should be noted that some details of the FIGS. have been simplified and are drawn to facilitate understanding of the inventive embodiments rather than to maintain strict structural accuracy, detail, and scale.

DESCRIPTION OF THE EMBODIMENTS

Reference will now be made in detail to exemplary embodiments of the present teachings, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B. The term "at least one of" is used to mean one or more of the listed items can be selected.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Exemplary embodiments provide a method and a system for reducing contamination built-up on surfaces of image members within a printing system. The image members, such as a fuser member, a pressure member, a heat member, and/or a donor member, can be contaminated from one or more printing processes by, for example, a release agent such as gelled oil, and/or a toner material such as particles or carrier beads in the toner. In one embodiment, the contaminated surfaces of image members can be decontaminated by a surface treatment. The surface treatment can include a combined UV radiation and ozone (or UV/ozone) treatment using at least one light source. Specifically, the light source can irradiate the contaminated surfaces at one or more UV wavelengths providing UV radiation energy and ozone to the surfaces so as to reduce or eliminate contamination thereon. In various embodiments, the light source can be positioned a distance d away from the contaminated surface during the surface treatment.

In an exemplary embodiment, UV radiation at specific wavelengths can break contaminant molecules on surfaces to decontaminate the image members. In addition, the decontamination effect of UV radiation can be enhanced by the presence of ozone. Ozone can be generated as a by-product of UV radiation of a particular wavelength which dissociates the atmospheric oxygen.

In various embodiments, the disclosed surface treatment can be conducted at any time following one or more printing processes and can include UV radiation having two or more distinct wavelengths, so that the amount of contamination on image member surfaces can be reduced by the combined treatment of UV radiation energy and ozone. The UV/ozone treatment used towards removing some organic contamination and the removal mechanism has been recognized and described in the Journal of Vacuum Science and Technology (Vol. 11, pages 474-475, 1974) by Sowell et al., entitled "Surface Cleaning by Ultraviolet Radiation", and in the Handbook of Semiconductor Wafer Cleaning Technology by J. R. Vig, entitled "Ultraviolet-ozone Cleaning of Semiconductor Surfaces", which are hereby incorporated by reference in their entirety.

In one embodiment, UV radiation comprised of a first wavelength $\lambda_1$ can be provided by an UV light source such a UV output lamp. This radiation will result in ozone formation from atmospheric oxygen. For example, the first wavelength $\lambda_1$ can be in a range from about 100 nm to about 210 nm. In a specific example, $\lambda_1$ can be about 185 nm.

A UV radiation comprised of a second wavelength $\lambda_2$ can be provided by the same or different UV light source such as an UV output lamp and can interact with most organic contaminants breaking them into free radicals and excited molecules. For example, the second group of wavelengths $\lambda_2$ can be in a range from about 210 nm to about 315 nm. In a specific example, $\lambda_2$ can be about 254 nm. In various embodiments, the wavelengths used for treating the surface can also be outside of these ranges as described above.

As a result of this UV/ozone surface treatment, contamination can be significantly reduced, for example, up to 90% or greater. In various embodiments, the decontamination efficiency can be affected by various factors, for example, the intensity and power of the UV light source as well as the exposure time to the UV radiation, along with the distance d between the UV light source and the contaminated surface.

FIG. 1 depicts a block diagram for an exemplary decontamination system in accordance with the present teachings. It should be readily apparent to one of ordinary skill in the art that the system comprising of a UV light source and a contaminated substrate, depicted in FIG. 1 represents a generalized schematic illustration and that other components/devices can be added or existing components/devices can be removed or modified.

The system depicted in FIG. 1 can include a light source 110, and a contaminated surface 120. The light source 110 can be placed or positioned spacing away from the contaminated surface at a distance d.

The UV light source 110 can include, for example, at least one UV light source, and can irradiate at various wavelengths. The wavelengths can include, for example, a first wavelength ranging from about 100 nm to about 210 nm, and a second wavelength ranging from about 210 nm to about 315 nm, such that the irradiation at one of first and second wavelengths can generate ozone. A UV/ozone treatment can then be applied to the contaminated surface 120.

In various embodiments, the light source 110 can include, for example, a mercury lamp, an amalgam lamp or their combinations. In various embodiments, the power of the UV output can be controlled by the light source 110. In one example, the light source 110 can include a low pressure mercury lamp including, for example, a 54 $mW/cm^2$-quartz tube mercury Pen Ray Lamp (Cole-Parmer, Vernon Hills, Ill.). In another example, the light source 110 can include a high power amalgam lamp, for example, having a UV output power of about 150 W (3 W/cm), which can be available from Heraeus Noblelight (Hanau, Germany).

The contaminated surface 120 can include a surface of image members of a xerographic imaging apparatus or a printer. The image members can include, but are not limited to a fuser member, a pressure or heat member, and/or a donor release member. In embodiments, the image member can be in a form of a cylinder, a belt or a sheet and can have an outermost (or topcoat) surface made of materials including, but not limited to, fluoropolymers such as fluoroelastomers, fluoroplastics, fluororesins, silicone elastomers, thermoelastomers, resins, and/or any other materials that can be used in the electrophotographic devices and processes. In an exemplary embodiment, the image member can have an outermost surface of fluoropolymer such as VITON® from E.I. DuPont de Nemours, Inc. (Wilmington, Del.), which may be contaminated by toner materials and/or fusing release agents during printing.

The contaminated surface 120 can be decontaminated using UV radiation provided from the light source 110 to allow a UV/ozone treatment.

As disclosed herein, the UV/ozone treatment can be used to decontaminate image member surfaces that are contaminated from printing cycles. In various embodiments, the combined use of UV radiation energy and ozone can be conducted simultaneously, sequentially or separately. Various treatment times or exposure times can be used accordingly.

In a specific example, the contamination on the contaminated surface 120 can be irradiated at a first wavelength $\lambda_1$ of about 185 nm that can be absorbed by the atmospheric oxygen to dissociate the atmospheric oxygen into atomic oxygen, which can be subsequently recombine to generate an active product such as ozone. In addition the UV light source 110 can output a UV radiation at a second wavelength $\lambda_2$ of about 254 nm that can break contaminant molecules into intermediate by-products, for example, ions, free radicals, and/or excited/neutral molecules. The intermediate by-products of ions, free radicals, excited molecules and/or neutral molecules can then react with the ozone to form, for example, $CO_2$, $N_2$, $H_2O$, etc. In various embodiments, the reaction product can be removed from the contaminated surface, completing the decontamination process.

Referring back to FIG. 1, the light source 110 can be placed a distance d away from the contaminated surface 120. In various embodiments, the distance d there-between can affect treatment efficiency of UV/ozone, as the lamp intensity decreases when increasing the distance d. For example, the distance d can be selected to allow the UV light source to efficiently treat or reduce contamination on the contaminated surface and, meanwhile, to avoid excessive absorption of radiations from the light source 110 by the ozone.

In various embodiments, the distance d can be on order of a few millimeters to effectively decontaminate the contaminated member and to avoid the excessive absorption of UV radiation in air. In some embodiments, the distance d can be from about 0 millimeters to about 20 millimeters. In other embodiments, the distance d can be no more than about 5 millimeters. Various embodiments, however, can include a distance d that is outside of these ranges.

In various embodiments, the irradiation time or the exposure time of the contaminated surface 120 can also be controlled to render enough time for treating the surface and to reduce contamination. In an exemplary embodiment, the irradiation time can be, for example, about 1 hour or shorter. In an additional example, the irradiation time can be about 20 minutes or shorter. In a further example, the irradiation time can be from about 5 to about 20 minutes.

In various embodiments, the treatment efficiency and/or the irradiation time can be affected by the UV output power of the light source 110. In an exemplary embodiment, by using light sources with high UV output power, the treatment time can be reduced to seconds. In a specific embodiment, when an amalgam lamp with a high UV output power of about 150 W (3 W/cm) (available from Heraeus Noblelight, Hanau, Germany) is used, the efficiency of the surface treatment can be significantly increased for all types of contaminants that result from printing processes, by simply reducing the exposure time from about 20 minutes, provided that a low UV output Pen Ray lamp (54 $mW/cm^2$) is used, to about 100 seconds provided that a high UV output Heraeus lamp (3 W/cm) is used. In various embodiments, the treatment time can be reduced even further, for example, between 0 and about 1 second for much higher UV output lamps.

In various exemplary embodiments, the contaminated surface 120 can be a contaminated outermost surface of a fuser member and can be contaminated from one or more organic contaminants from printing processes including, but not limited to, a release agent such as gelled fuser oil, particles or carrier beads in the toner, which include, for example, polyester toner resin and zinc fumarate from zinc stearate additives in the toner.

Specifically, a fusing system can include, for example, a fuser roll, a pressure roll and a substrate transport. The substrate transport can direct the image-receiving substrate (e.g., a photoreceptor) with a toner powder image through a nip between the fuser roll that is being heated at a certain temperature and the pressure roll, where the toner image can be affixed to the image receiving substrate.

Through repeated cycles, the toner present on the image receiving substrate can fail to penetrate, e.g., the paper and can be transferred to the fuser roll instead. The toner material can stick to the roll and build-up on the fuser roll as contamination. Such contamination can come in contact with subsequent substrates that pass through the fusing system, and thus affecting the image quality of the final toner image.

The contamination that builds-up on the fuser roll can be treated using the system and method shown in FIG. 1 by irradiating the contaminated surface at one or more appropriate UV wavelengths, applying combined UV/ozone treatment to reduce or eliminate contaminants on contaminated fuser roll surfaces.

In one embodiment, there is provided a method for reducing an amount of PDMS gelled oil contamination built-up on an exemplary fuser roll by treating the contaminated surface with a combined ultraviolet radiation and ozone. The UV/ozone treatment can be provided by one or more UV light sources emitting at least a first wavelength of about 100 nm to about 210 nm and a second wavelength of about 210 nm to about 315 nm.

In one embodiment, there is provided a method for reducing an amount of toner resin contamination built-up on an exemplary fuser roll by treating the contaminated surface with a combined ultraviolet radiation and ozone. The UV/ozone treatment can be provided by one or more UV light sources emitting at least a first wavelength of about 100 nm to about 210 nm and a second wavelength of about 210 nm to about 315 nm.

In one embodiment, there is provided a method for reducing an amount of zinc fumarate contamination built-up on an exemplary fuser roll by treating the contaminated surface with a combined ultraviolet radiation and ozone. The UV/ozone treatment can be provided by one or more UV light sources emitting at least a first of wavelength of about 100 nm to about 210 nm and a second wavelength of about 210 nm to about 315 nm.

In various embodiments, the system and method shown in FIG. 1 can be fast, fairly inexpensive and easy solutions to be implemented in the electrophotographic field. In an exemplary embodiment, the light source can be permanently installed in an image member assembly, such as a fuser assembly, and used for surface cleaning cycles after a certain number of printing jobs. Alternatively, the light source can be turned off while printing so as to reduce unnecessary ozone generation.

EXAMPLES

The UV/ozone decontamination experiments were carried out on a VITON® fuser roll which underwent 25,000 prints testing and where a 13-coloured toner stripe target was used. The UV/ozone treatment was performed using a 54 mW/cm$^2$ quartz tube mercury Pen Ray Lamp (Cole-Parmer) to irradiate the VITON® surface of the fuser roll at a first and second wavelength of about 254 nm and 185 nm respectively. In this case, the contaminated surface was treated by UV/ozone for about 20 minutes A higher UV output Heraeus amalgam lamp, available from Hanau, Germany, with an output power of 3 W/cm, was also used in the decontamination experiments carried out on a VITON® surface, which was exposed for about 100 seconds in this example.

FIGS. 2A-2B, FIGS. 3A-3B, and FIGS. 4A-4B show exemplary decontamination results for all three types of contaminants such as PDMS gelled fuser oil, polyester toner resin, and zinc fumarate, respectively. The results were characterized by the contaminated surface area coverage, which was measured by Attenuated Total Reflection (ATR) Fourier Transform Infrared (FT-IR) spectroscopy. Specifically, in order to show the contamination reduction, the amount of surface area coverage by each contaminant was measured before and after the UV/Ozone treatment.

As shown, the contaminated surface areas of the PDMS gelled oil (see FIGS. 2A-2B), the polyester toner resin (see FIGS. 3A-3B), and the zinc fumarate (see FIGS. 4A-4B) were significantly reduced from a high value M to a low value N after the UV/ozone treatment. In each experiment, two separate samples from the same contaminated fuser roll were cut and treated by UV/ozone using appropriate UV light sources and were measured by ATR FT-IR to examine the surface area coverage by the contamination of the PDMS gelled oil, the polyester toner resin and the zinc fumarate before and after the surface treatment.

Figure 2A:
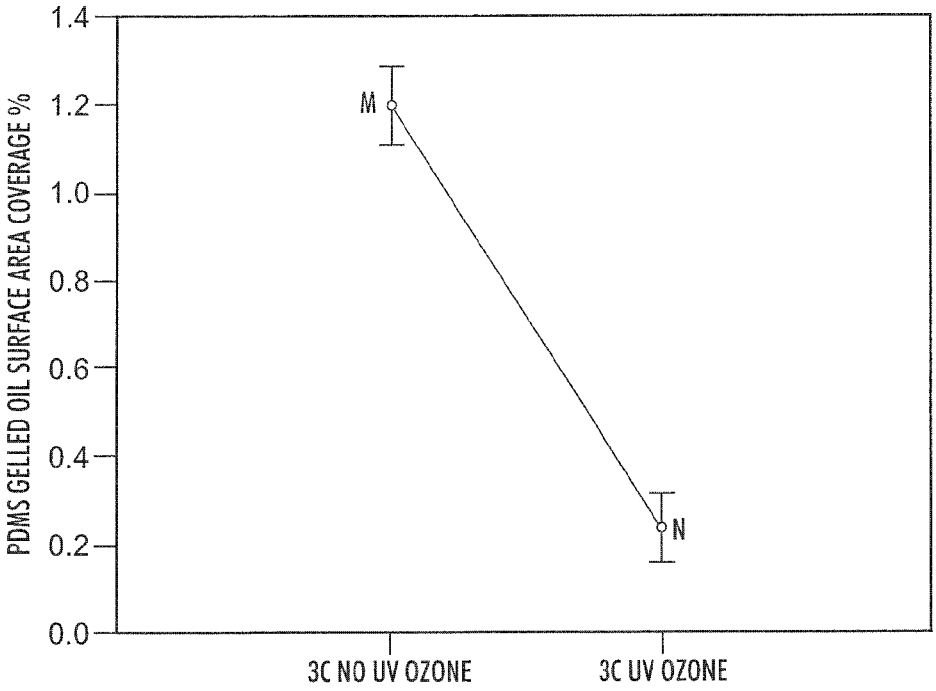
FIGS. 2A-2B depict exemplary decontamination results of PDMS gelled oil on a fuser roll after a 20 minute treatment using a low UV output lamp and 100 second treatment using a high UV output lamp respectively, in accordance with various embodiments of the present teachings.
Figure 2B:
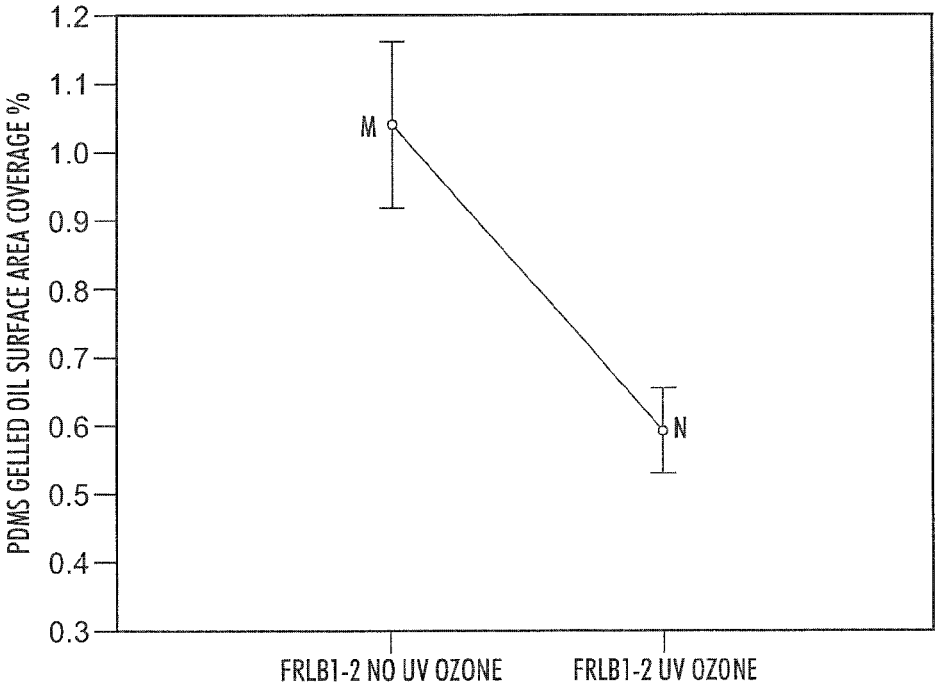
Figure 3A:
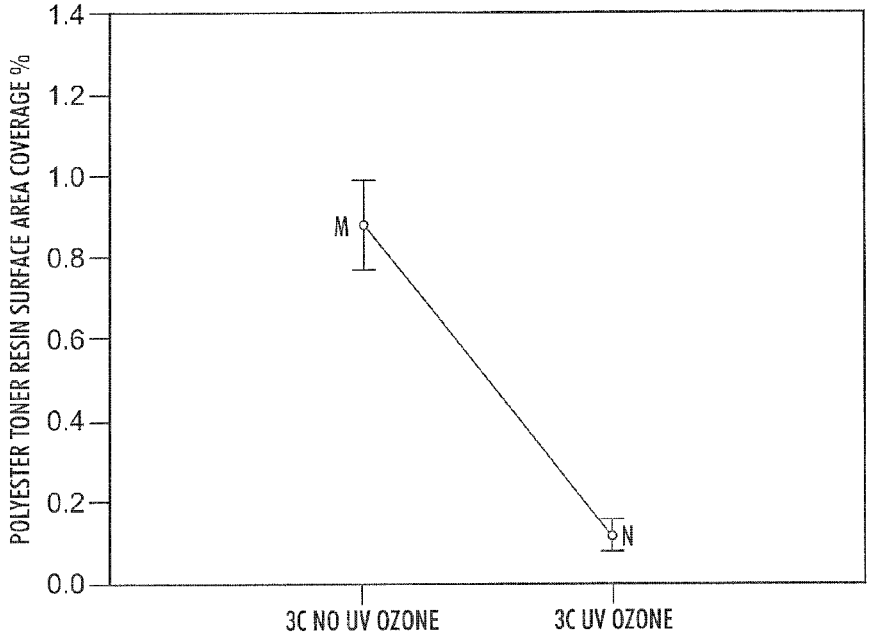
FIGS. 3A-3B depict exemplary decontamination results of polyester toner resin on a fuser roll after a 20 minute treatment using a low UV output lamp and 100 second treatment using a high UV output lamp respectively, in accordance with various embodiments of the present teachings.
Figure 3B:
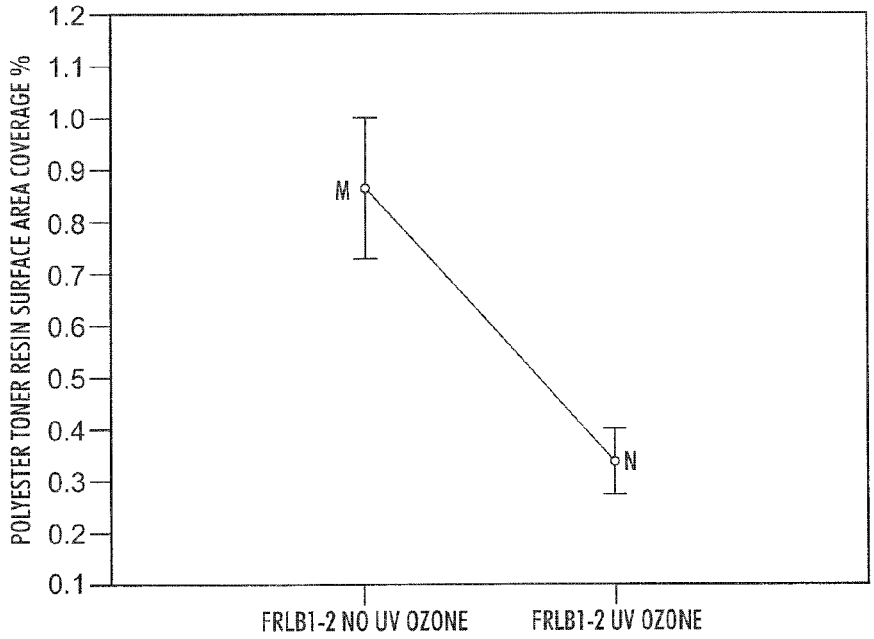
Figure 4A:
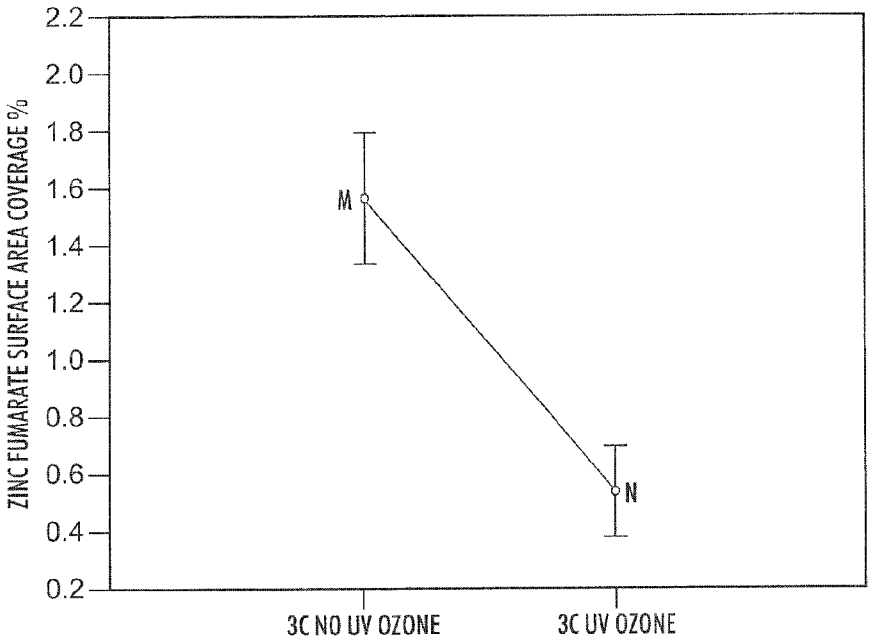
FIGS. 4A-4B depict exemplary decontamination results of zinc fumarate on a fuser roll after a 20 minute treatment using a low UV output lamp and 100 second treatment using a high UV output lamp respectively, in accordance with various embodiments of the present teachings.
Figure 4B:
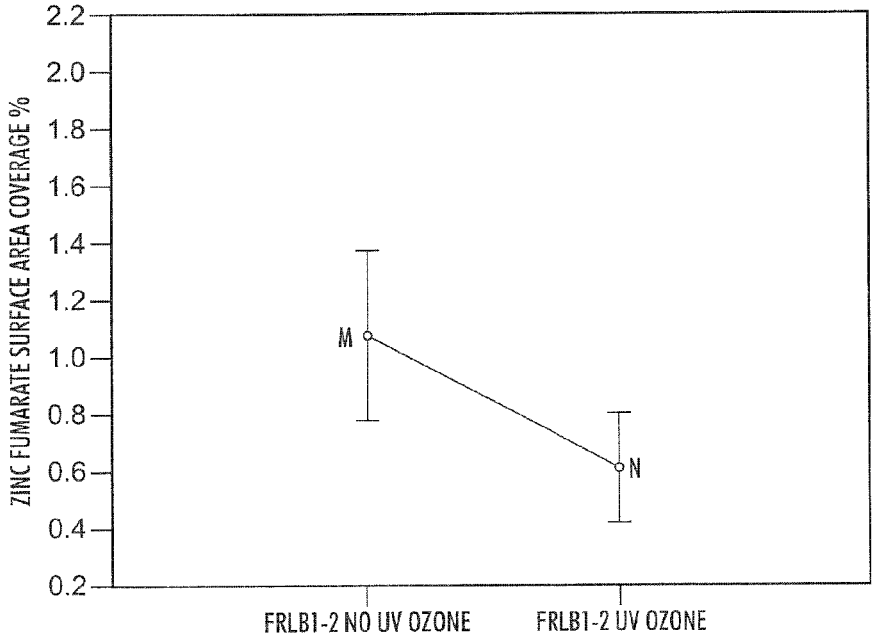

In addition, FIGS. 2A, 3A and 4A were experimental results generated by a 20-minute-UV/ozone treatment using the low pressure Pen Ray Lamp, while FIGS. 2B, 3B and 4B were experimental results generated by a 100-second-UV/ozone treatment using the high UV output Heraeus amalgam lamp.

Figure 5:
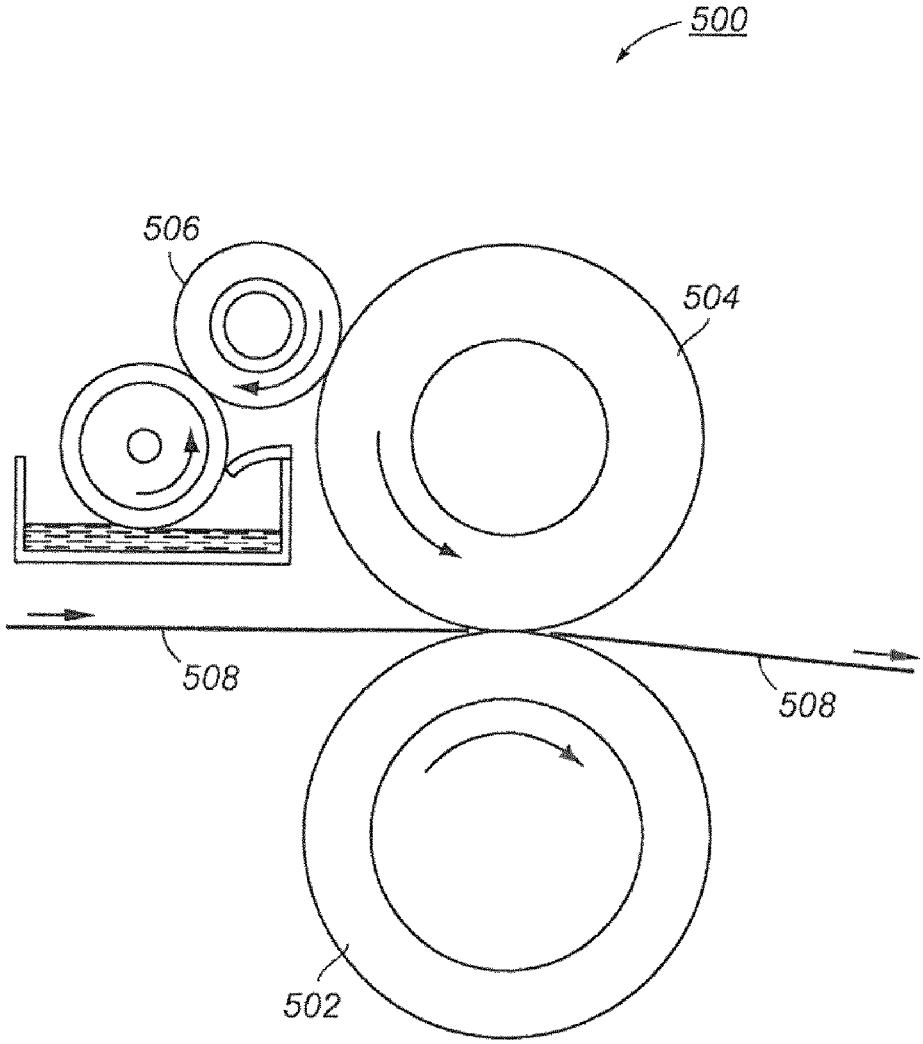
FIG. 5 is a schematic depiction of an exemplary system in accordance with various aspects of an embodiment of the present teachings.

FIG. 5 depicts an exemplary electrophotographic system 500 in accordance with various aspects of an embodiment of the present teachings. The FIG. 5 system can include a UV source to clean contamination from a surface as described herein and depicted, for example, in FIG. 1. FIG. 5 depicts a pressure member (pressure roll) 502, a fuser member (fuser roll or heat member) 504, a donor member 506, and a receiving substrate 508 such as a paper sheet.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A method for treating a surface of an image member of a xerographic imaging apparatus comprising:

providing an image member, wherein an outer surface of the image member comprises one or more of fluoropolymers, silicone elastomers, thermoelastomers, resins, and combinations thereof and is contaminated from a xerographic printing process by one or more of a release agent and a toner material;

imagining, using the image member in the xerographic imaging apparatus, one or more articles for reproduction; and irradiating, by a lamp positioned within the xerographic imaging apparatus, the contaminated surface of the image member at one or more ultraviolet (UV) wavelengths to apply a combined UV and ozone treatment so as to reduce a contamination of the contaminated surface, wherein the contamination comprises toner resin, PDMS gelled oil, and toner resin byproducts.

2. The method of claim 1, further comprising irradiating the contaminated surface of the image member at a first UV wavelength ranging from about 100 nm to about 210 nm, and irradiating the contaminated surface at a second UV wavelength ranging from about 210 nm to about 315 nm.

3. The method of claim 1, further comprising positioning the lamp a distance d away from the contaminated surface, wherein the at least one light source irradiates at the one or more UV wavelengths.

4. The method of claim 3, further comprising determining the distance d based on an irradiation efficiency that optimizes the decontamination of the contaminated surface and eliminates excessive absorption of the UV radiation from the UV light source by the ozone itself.

5. The method of claim 3, further comprising controlling an output power of the lamp, wherein the lamp comprises a mercury lamp, an amalgam lamp or combinations thereof.

6. The method of claim 1, further comprising determining an irradiation time on the contaminated surface based on an irradiation power of the one or more UV wavelengths.

7. The method of claim 1, wherein the irradiation of the contaminated surface reduces an amount of a polyester toner resin contamination built-up on a surface of a fuser member from one or more printing processes.

8. The method of claim 1, wherein the irradiation of the contaminated surface reduces an amount of a PDMS gelled oil contamination built-up on a surface of a fuser member from one or more printing processes.

9. The method of claim 1, wherein the irradiation of the contaminated surface reduces an amount of a zinc fumarate contamination built-up on a surface of a fuser member from one or more printing processes.

10. A method for reducing a contamination on an image member of a xerographic imaging apparatus comprising:

providing an image member, wherein an outer surface of the image member comprises one or more of fluoropolymers, silicone elastomers, thermoelastomers, resins, and combinations thereof and is contaminated with toner resin, PDMS gelled oil, and toner resin byproducts from a xerographic printing process;

imagining, using the image member in the xerographic imaging apparatus, one or more articles for reproduction;

placing a UV lamp a distance d away from the contaminated surface of the image member;

irradiating the contaminated surface at a first UV wavelength using the UV lamp; and irradiating the contaminated surface at a second UV wavelength using the UV lamp, wherein the irradiation at one of the first and second UV wavelengths generates ozone to remove the contamination.

11. The method of claim 10, wherein the one of the first and second UV wavelengths ranges from about 100 nm to about 210 nm and the other of the first and second UV wavelengths ranges from about 210 nm to about 315 nm.

12. The method of claim 10, wherein the distance d between the UV lamp and the contaminated surface is about 20 millimeters or less.

13. The method of claim 10, further comprising irradiating a polyester toner resin contaminated surface of a fuser member to reduce an amount of the polyester toner resin contamination.

14. The method of claim 10, further comprising irradiating a PDMS gelled oil contaminated surface of a fuser member to reduce an amount of the PDMS gelled oil contamination.

15. The method of claim 10, further comprising irradiating a zinc fumarate contaminated surface of a fuser member to reduce an amount of the zinc fumarate contamination.

16. An electrophotographic system comprising:

an image member comprising an outer surface which comprises one or more of fluoropolymers, silicone elastomers, thermoelastomers, resins, and combinations thereof; and a lamp positioned at a distance d from the image member surface within the electrophotographic system such that the distance d permits the light source to decontaminate the image member surface from a release agent, a toner resin, a PDMS gelled oil, and toner resin byproducts, and zinc fumarate, wherein the lamp is capable of irradiating at one or more UV wavelengths to apply a combined UV and ozone treatment to the surface of the image member.

17. The electrophotographic system of claim 16, wherein the one or more UV wavelengths comprise a first UV wavelength ranging from about 100 nm to about 210 nm and a second wavelength ranging from about 210 nm to about 315 nm.

18. The electrophotographic system of claim 16, wherein the surface of the image member comprises a material selected from the group consisting of a silicone elastomer, a fluoroelastomer, a thermoelastomer, a resin, a fluororesin, a fluoroplastic and combinations thereof.

19. The electrophotographic system of claim 16, wherein the image member is one of a fuser member, a pressure member, a heat member, and a donor member.

* * * * *